US008180248B2

(12) United States Patent
Sato et al.

(10) Patent No.: US 8,180,248 B2
(45) Date of Patent: May 15, 2012

(54) IMAGE FORMING APPARATUS

(75) Inventors: Masahiro Sato, Kanagawa (JP); Atsuyuki Kitamura, Kanagawa (JP); Junichi Murakami, Kanagawa (JP); Satoru Torimaru, Kagoshima (JP); Atsushi Ogihara, Kanagawa (JP); Tetsuji Okamoto, Kanagawa (JP); Shuichi Nishide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 492 days.

(21) Appl. No.: 12/510,308

(22) Filed: Jul. 28, 2009

(65) Prior Publication Data

US 2010/0209135 A1 Aug. 19, 2010

(30) Foreign Application Priority Data

Feb. 17, 2009 (JP) ..... 2009-034194

(51) Int. Cl.
*G03G 5/00* (2006.01)
*G03G 21/16* (2006.01)

(52) U.S. Cl. ..... 399/107; 399/111; 399/227

(58) Field of Classification Search ..... 399/111, 399/110, 227, 107

See application file for complete search history.

(56) References Cited

U.S. PATENT DOCUMENTS 4,939,541 A * 7/1990 Sugiura
5,184,178 A * 2/1993 Takayanagi et al. ..... 399/111
2003/0118367 A1* 6/2003 Omata et al. ..... 399/110

FOREIGN PATENT DOCUMENTS

JP 2003-098823 4/2003

* cited by examiner

*Primary Examiner* — Susan Lee
(74) *Attorney, Agent, or Firm* — Fildes & Outland, P.C.

(57) ABSTRACT

An image forming apparatus includes: a first unit including at least a development unit that develops an electrostatic latent image and a first developer container containing a developer; an image carrier that holds an electrostatic latent image to be developed by the development unit; a transfer unit that transfers a developer image developed by the development unit onto a recording medium; a fixing device that fixes a developer image transferred to the recording medium by the transfer unit onto a recording medium; and an image forming apparatus main body in which the first unit is installed, the image forming apparatus main body being configured such that a second unit including at least plural second developer containers respectively containing developers of different colors and development units for respective colors is installable instead of the first unit and, when the second unit is installed, a loop transport path is provided to allow the recording medium having the developer image fixed thereon by the fixing device to be transported around the second unit and toward the transfer unit.

9 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2009-034194 filed Feb. 17, 2009.

BACKGROUND

Technical Field

The present invention relates to an image forming apparatus.

SUMMARY

According to an aspect of the invention, there is provided an image forming apparatus including a first unit including at least a development unit that develops an electrostatic latent image and a first developer container containing a developer, an image carrier that holds an electrostatic latent image to be developed by the development unit, a transfer unit that transfers a developer image developed by the development unit onto a recording medium, a fixing device that fixes the developer image transferred to the recording medium by the transfer unit onto a recording medium, and an image forming apparatus main body in which the first unit is installed, the image forming apparatus main body being configured such that a second unit including at least plural second developer containers respectively containing developers of different colors for developing an electrostatic latent image and development units for respective colors is installable instead of the first unit and, when the second unit is installed, a loop transport path is provided to allow a recording medium having a developer image fixed thereon by the fixing device to be transported around the second unit and toward the transfer unit.

BRIEF DESCRIPTION OF THE DRAWINGS

Exemplary embodiments of the present invention will be described in detail based on the following figures, wherein.

DETAILED DESCRIPTION

In the following, exemplary embodiments of the present invention will be described, based on the drawings.

Figure 1:
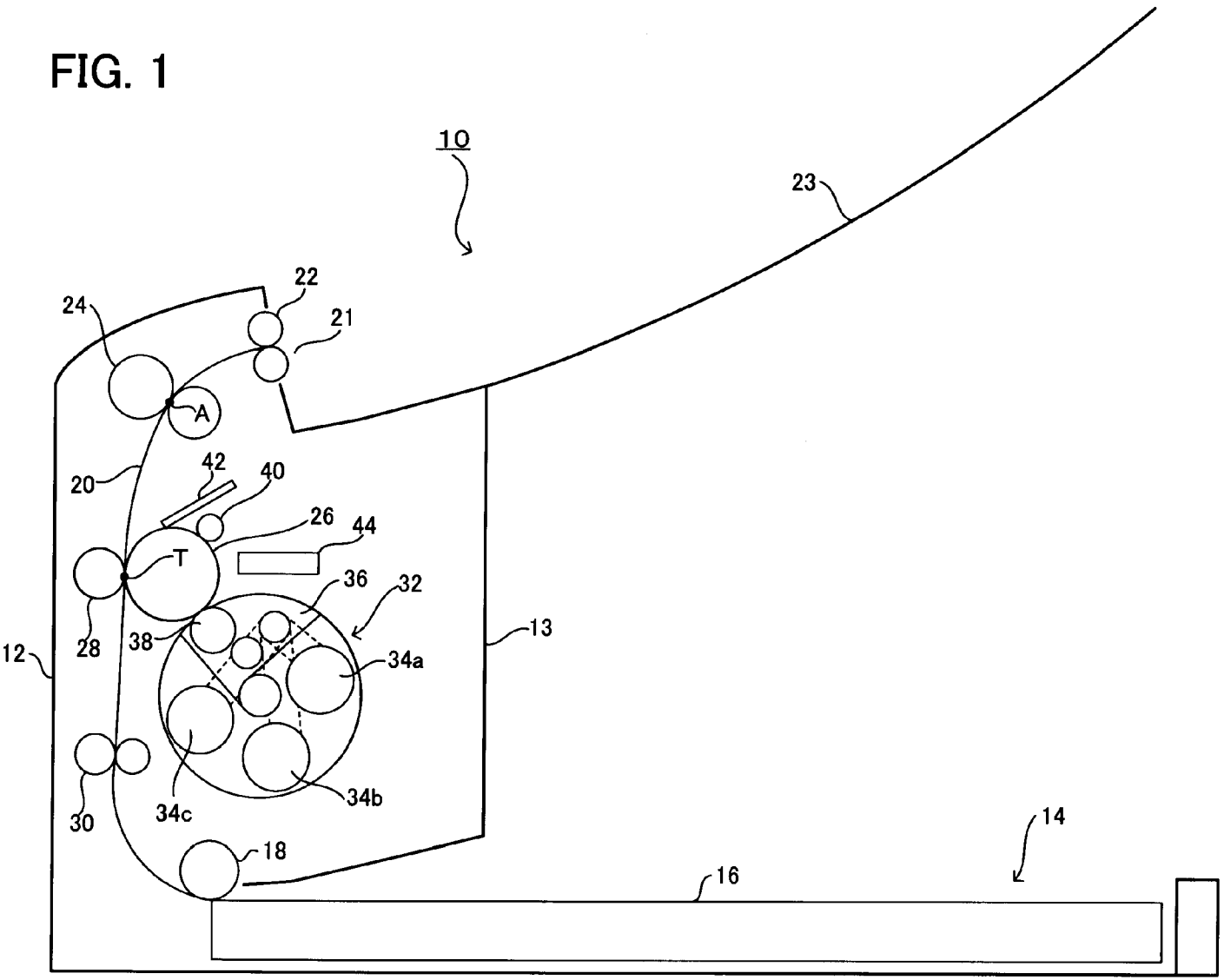
FIG. 1 is a side view depicting an overview of an image forming apparatus according to a first exemplary embodiment of the invention.

FIG. 1 depicts an overview of an image forming apparatus 10 according to a first exemplary embodiment of the invention. The image forming apparatus 10 has an image forming apparatus main body 12 and a paper feed unit 14 which may have, for example, one stage disposed at the bottom of the image forming apparatus main body 12. A cover 13 is removably installed on the image forming apparatus main body 12 in the rear side (right side in FIG. 1) of the apparatus main body 12. The image forming apparatus main body 12 is configured so that a transport path forming unit 48 to be described later can be installed instead of the cover 13.

The paper feed unit 14 includes a paper cassette 16 in which sheets such as paper are contained. The paper cassette 16 is configured to allow feeding of different sizes of sheets; for example, paper of A4 size is a maximum size of sheet that can be fed. Here, the paper cassette 16 allows sheets of A4 size to be set therein with their long sides being along the transport direction. A pickup roller 18 is disposed at the top of the paper cassette 16 to pick up a sheet from the paper cassette 16.

The pickup roller 18 is driven by a driving mechanism which is not shown and rotates to feed a sheet toward a main transport path 20. The main transport path 20 is a sheet passage from the pickup roller 18 to an exit port 21 located at the top of the image forming apparatus main body 12. Eject rollers 22 are provided in proximity to the exit port 21. The eject rollers 22 rotate in a direction to eject a sheet through the exit port 21 to a paper collector 23 provided on the top of the image forming apparatus main body 12.

Along the main transport path 20, upstream of a fixing device 24, an image carrier 26 and a transfer roller 28 with its circumferential surface made of an elastic body are disposed. Upstream of the image carrier 26 and the transfer roller 28, registration rollers 30 are disposed.

Thus, a sheet picked up by the pickup roller 18 from the paper cassette 16 in the paper feed unit 14 is guided to the main transport path 20. Timing to transport the sheet is adjusted by the registration rollers 30, so that the sheet will timely pass between the image carrier 26 and the transfer roller 28. During this passage, a black developer image is transferred onto the sheet. The thus transferred black developer image is fixed onto the sheet by the fixing device 24 and the sheet is ejected by the eject rollers 22.

For example, in a nearly center and lower part of the image forming apparatus main body 12, a first development unit 32 is removably installed. The first development unit 32 includes developer containers 34*a* to 34*c*, each containing a black developer, and a development device 36 that receives the black developer from the developer containers 34*a* to 34*c* under the driving force of a driving source which is not shown and makes an electrostatic latent image visible, present on the image carrier 26 with use of the black developer. The development device 36 also includes a development roller 38 that faces and abuts the image carrier 26.

The image forming apparatus 10 is configured such that, in order to enable color printing, a second development unit 46 can be installed in the image forming apparatus main body 12 instead of the first development unit 32.

On the upper side of the image carrier 26, a charging device 40 formed of, for example, a charging roller is provided to evenly charge the image carrier 26. Moreover, an image carrier cleaner 42 abuts the image carrier 26 in a position upstream of the charging device 40 in the direction of rotation of the image carrier 26. The image carrier cleaner 42 scrapes away developer particles remaining on the image carrier 26 after transfer.

Between the first development unit 32 and the charging device 40, an optical writing device 44 is disposed that forms an electrostatic latent image on the image carrier 26 charged by the charging device 40 by a beam such as a laser beam. In the front (the left side in FIG. 1) of the image carrier 26, the above-mentioned transfer roller 28 is located. The transfer roller 28 transfers a developer image made visible by the first development unit 32 onto a sheet in a transfer position T.

Downstream of the transfer position T, the fixing device 24 is disposed. The fixing device 24 has a heating roller and a pressure roller and fixes a developer image onto a sheet by applying heat and pressure to the developer image. This is done by moving forward a sheet having a developer image transferred thereto by the transfer roller 28 from the image carrier 26, while nipping the sheet at a contact (nip: fixing position A) between the heating roller and the pressure roller.

Then, a description is provided for a method for enabling the image forming apparatus 10 to do color printing.

Figure 2:
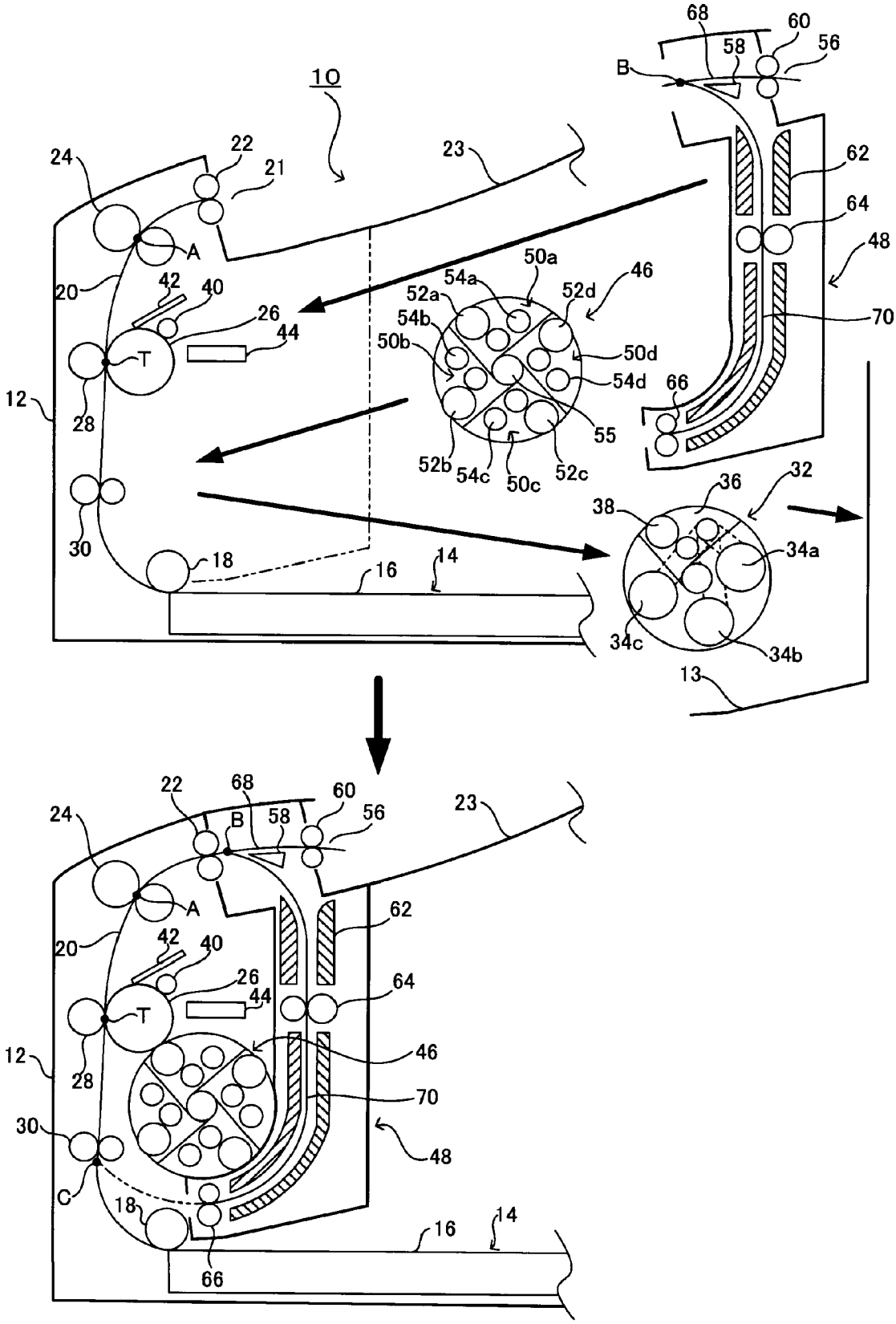
FIG. 2 is a side view depicting a process of changing the image forming apparatus of the first exemplary embodiment of the invention so that it becomes able to perform color printing.

FIG. 2 is a side view depicting a process of changing the image forming apparatus 10 of the first exemplary embodiment of the invention so that it becomes able to perform color printing.

As can be seen in FIG. 2, the image forming apparatus 10 is configured such that the first development unit 32 can be removed from the image forming apparatus main body 12 after the removal of the cover 13 from the image forming apparatus main body 12 rearward (to the right in FIG. 2).

Therefore, changing the image forming apparatus 10 so that it becomes able to perform color printing can be done in the following procedure: after removing the cover 13 from the image forming apparatus main body 12, the user replaces the first development unit 32 by the second development unit 46 which is now installed in the image forming apparatus main body 12; then, the user installs the transport path forming unit 48 instead of the cover 13 in the image forming apparatus main body 12.

The second development unit 46 includes development devices 50*a* to 50*d* which respectively contain developers for four colors: black, magenta, cyan, and yellow. The development devices 50*a* to 50*d* respectively include development rollers 52*a* to 52*d* and developer containers 54*a* to 54*d*. The developers contained in the developer containers 54*a* to 54*d* are respectively supplied to the development rollers 52*a* to 52*d* and these rollers sequentially make an electrostatic latent image visible present on the image carrier 26, using the developers of each color. The second development unit 46 rotates about its rotating shaft 55 and this rotation allows each of the development devices 50*a* to 50*d* to move to a position where it faces and abuts the image carrier 26 in turn.

A driving source to drive the rotation of the second development unit 46 is a common driving source which is also used for conveying a black developer from the developer containers 34*a* to 34*c* to the first development unit 32. In the image forming apparatus 10, as regards necessary driving sources for the first development unit 32 and the second development unit 46, the image forming apparatus main body 12 may be provided with these driving sources and the first development unit 32 and the second development unit 46 may be provided with these driving sources separately.

The transport path forming unit 48 includes a switching pawl 58, exit rollers 60, a guide part 62, and transport rollers 64, 66 and this unit provides an exit path 68 and a sub-transport path 70. At a diverging point B, the switching pawl 58 switches the route of a sheet to one of the exit path 68 and the sub-transport path 70 through which the sheet ejected by the eject rollers 22 is to be transported. The exit rollers 60 carry a sheet out through an exit port 56 to the paper collector 23, if switching to the exit path 68 is done by the switching pawl 58 so that the sheet ejected by the eject rollers 22 will be transported through the exit path 68. The guide part 62 is, for example, formed of plural ribs disposed so as to face each other across the sub-transport path 70. The guide part 62 guides a sheet ejected by the eject rollers 22 to a position (a converging point C) upstream of the registration rollers 30 in the main transport path 20, if switching to the sub-transport path 70 is done by the switching pawl 58 so that the sheet ejected by the eject rollers 22 will be transported through the sub-transport path 70. The transport rollers 64 are disposed, for example, in the middle of the guide part 62 and transport a sheet passing through the sub-transport path 70 toward the transport rollers 66. The transport rollers 66 are disposed, for example, downstream of the guide part 62 to transport a sheet passing through the sub-transport path 70 toward the converging point C.

In this way, the transport path forming unit 48 provides the exit path 68 that relays a sheet ejected from the image forming apparatus main body 12 by the eject rollers 22 toward the paper collector 23 and transports the sheet to eject it through the exit port 56 to the paper collector 23, and the sub-transport path 70 that transports a sheet to a position upstream of the registration rollers 30 in the main transport path 20 to transport the sheet ejected from the image forming apparatus main body 12 by the eject rollers 22 to the transfer position T again.

When the transport path forming unit 48 is installed in the image forming apparatus main body 12, a loop transport path is formed in which a sheet is carried from the position (the converging point C) upstream of the registration rollers 30 in the main transport path 20 through the transfer position T and the fixing position A and, at the diverging point B, the sheet is guided to the sub-transport path 70 and transported to the converging point C again through the sub-transport path 70.

Next, an overall operation (color printing) of the image forming apparatus 10 is described.

When a signal to make an image is delivered, the image carrier 26 is evenly charged by the charging device 40. Based on the image signal, a beam corresponding to a black image is emitted from the optical writing device 44 toward the charged image carrier 26. The beam from the optical writing device 44 irradiates the surface of the image carrier 26 and an electrostatic latent image is formed thereon.

The electrostatic latent image present on the image carrier 26 is developed with a black developer supplied to the development roller 52*a* in the development device 50*a*. Then, the developed image is transferred on to a sheet fed from the paper feed unit 14. The sheet having the black developer image transferred thereto is guided to the fixing device 24 where the developer image is fixed by the heating roller and the pressure roller.

Then, the sheet having the black developer image fixed thereon is guided toward the sub-transport path 70 by the switching pawl 58. The sheet guided to the sub-transport path 70 is guided by the guide part 62 and transported by the transport rollers 64, 66 toward the converging point C.

Developer particles remaining on the image carrier 26 are scraped away by the image carrier cleaner 42.

Again, the image carrier 26 is evenly charged by the charging device 40. Based on the image signal, a beam corresponding to a magenta image is emitted from the optical writing device 44 toward the charged image carrier 26. The beam from the optical writing device 44 irradiates the surface of the image carrier 26 and an electrostatic latent image is formed thereon.

The electrostatic latent image present on the image carrier 26 is developed by a magenta developer supplied to the development roller 52*b* in the development device 50*b* and the developed image is overlayingly transferred onto the sheet.

The sheet having the magenta developer image transferred thereto is guided to the fixing device 24 where the developer image is fixed by the heating roller and the pressure roller. The sheet having the magenta developer image fixed thereon is guided toward the sub-transport path 70 by the switching pawl 58. The sheet guided to the sub-transport path 70 is guided by the guide part 62 and transported by the transport rollers 64, 66 toward the converging point C. Developer particles remaining on the image carrier 26 are scraped away by the image carrier cleaner 42.

The sheet is guided to the sub-transport path 70 three times in all and goes around the second development unit 46 by three turns. Like the black and magenta developer images, when developer images developed by cyan and yellow developers are fixed onto the sheet by the fixing device 24, a color image into which all the developer images are combined is formed on the sheet. The sheet having the color image fixed thereon is guided to the exit path 68 by the switching pawl 58 and ejected by the exit rollers 60 through the exit port 56 to the paper collector 23.

Then, a description is provided for a modification example to the image forming apparatus 10 of the first exemplary embodiment of the invention.

Figure 3:
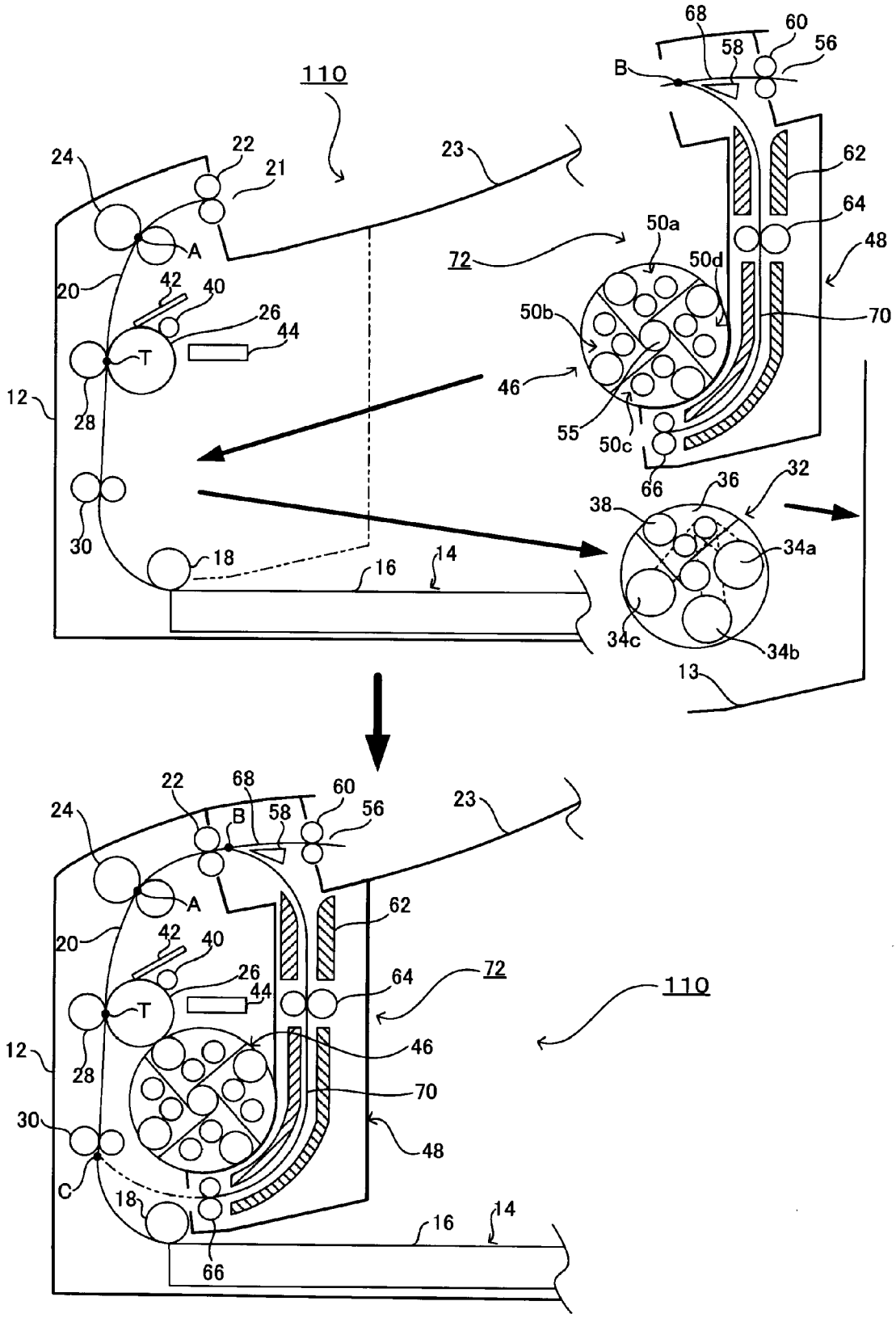
FIG. 3 is a side view depicting a process of enabling a modification example for the image forming apparatus of the first exemplary embodiment of the invention to perform color printing.

FIG. 3 is a side view depicting a process of enabling a modification example (image forming apparatus 110) for the image forming apparatus 10 of the first exemplary embodiment of the invention to perform color printing.

In the image forming apparatus 110, components that are substantially the same as those constituting the image forming apparatus 10 shown in FIG. 2 (including the second development unit 46 and the transport path forming unit 48) are assigned the same reference numbers.

As can be seen in FIG. 3, the image forming apparatus 110 is configured such that a color printing unit 72 in which the second development unit 46 and the transport path forming unit 48 are integrated can be installed after the removal of the cover 13 and the first development unit 32 from the image forming apparatus main body 12.

Therefore, after removing the cover 13 and the first development unit 32 from the image forming apparatus main body 12, the user can change the image forming apparatus 110 so that it becomes able to perform color printing by installing the color printing unit 72.

Next, an image forming apparatus 120 according to a second exemplary embodiment of the invention is described.

Figure 4:
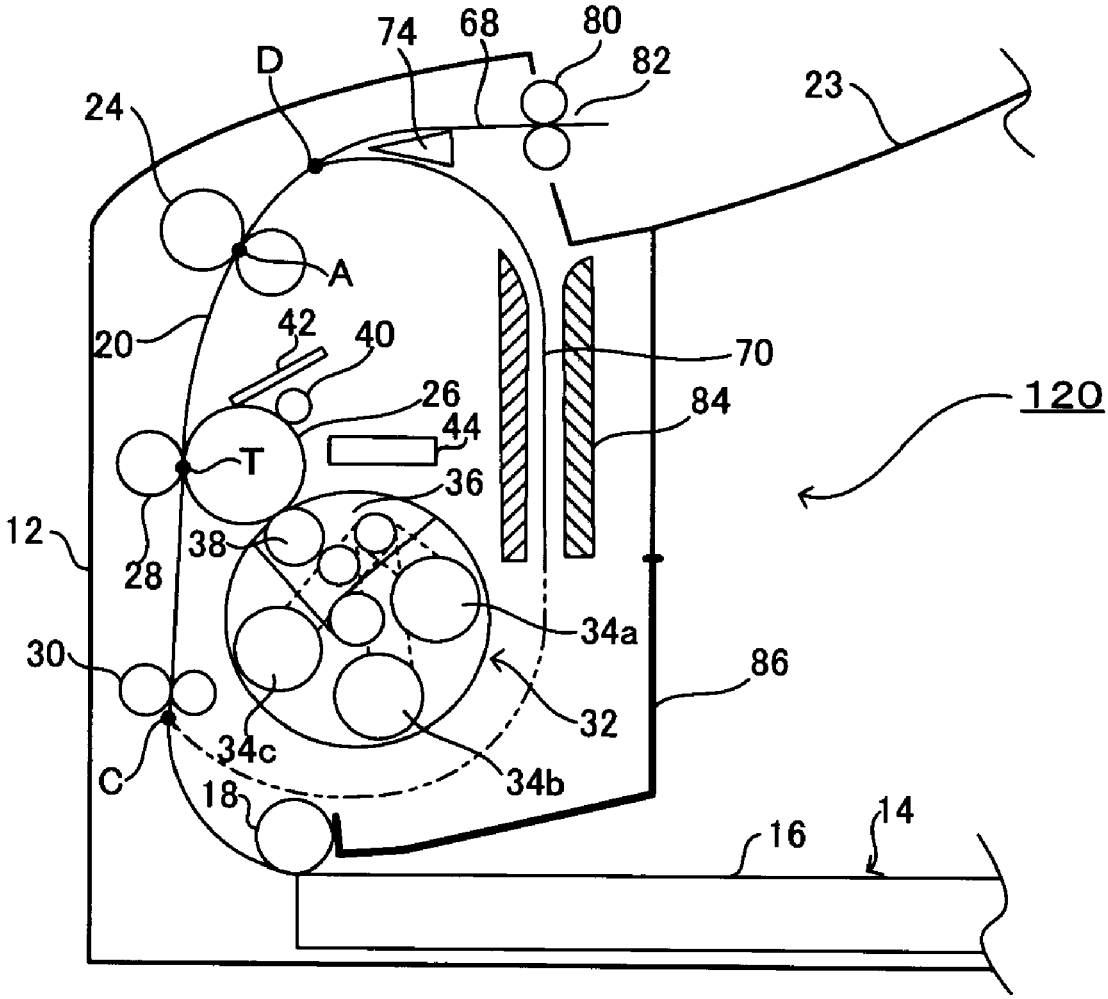
FIG. 4 is a side view depicting an overview of an image forming apparatus according to a second exemplary embodiment of the invention.

FIG. 4 is a side view depicting an overview of the image forming apparatus 120 according to the second exemplary embodiment of the invention.

In the image forming apparatus 120, components that are substantially the same as those constituting the image forming apparatus 10 shown in FIG. 2 are assigned the same reference numbers.

At a diverging point D, a switching pawl 74 switches the route of a sheet to one of the exit path 68 and the sub-transport path 70 through which the sheet having a developer image fixed thereon by the fixing device 24 is to be transported. Eject rollers 80 carries a sheet out through an exit port 82 toward the paper collector 23, if switching to the exit path 68 is done by the switching pawl 74 so that the sheet having a developer image fixed thereon by the fixing device 24 will be transported through the exit path 68. A guide part 84 is formed of plural ribs disposed so as to face each other across an upper part of the sub-transport path 70. Thus, in the image forming apparatus main body 12, the exit path 68 and the upper part of the sub-transport path 70 are provided beforehand. In the lower part of the rear side (the right side in FIG. 4) of the image forming apparatus main body 12, a cover 86 is removably installed on the image forming apparatus main body 12.

Then, a method for enabling the image forming apparatus 120 to perform color printing is described.

Figure 5:
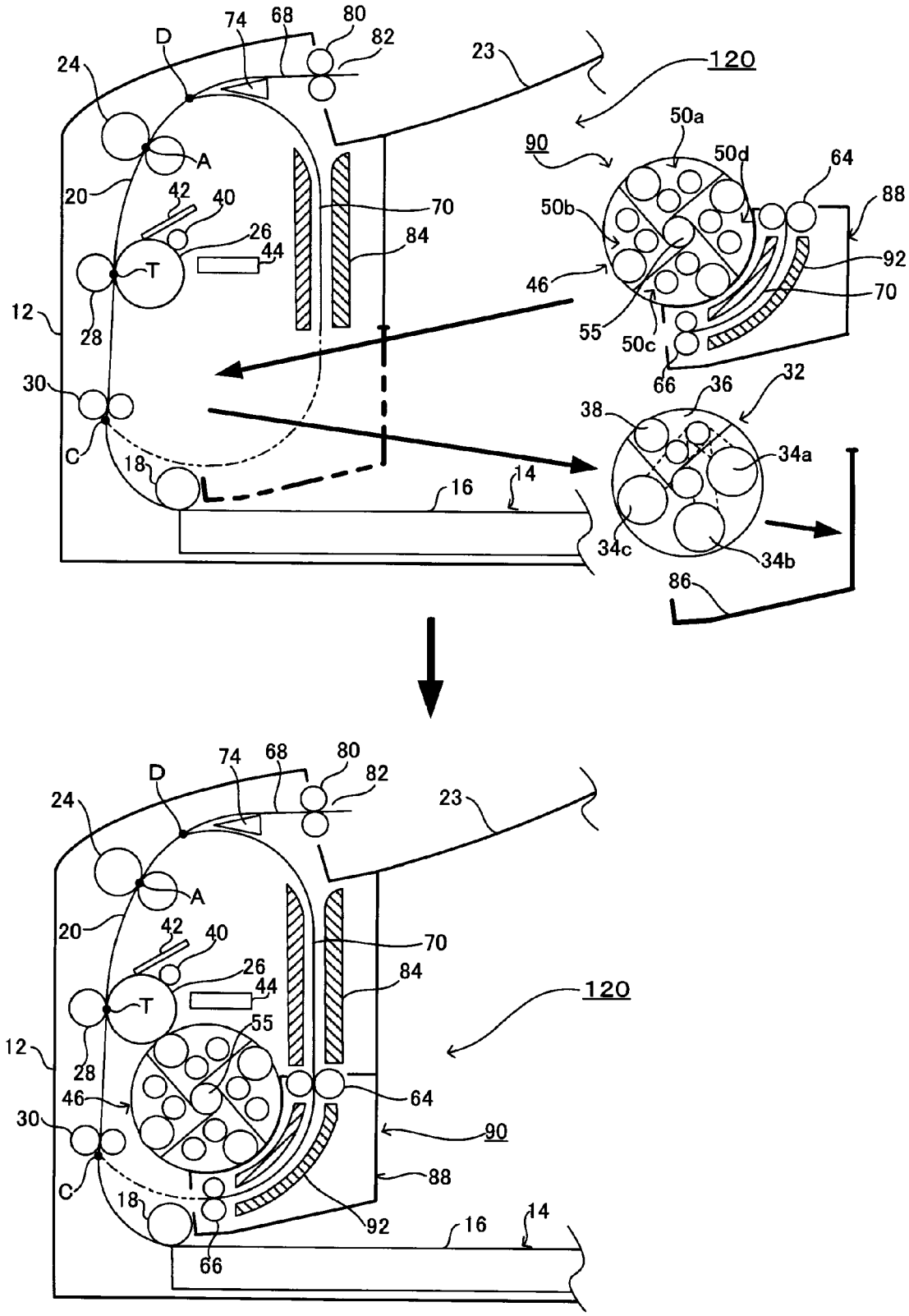
FIG. 5 is a side view depicting a process of changing the image forming apparatus of the second exemplary embodiment of the invention so that it becomes able to perform color printing.

FIG. 5 is a side view depicting a process of changing the image forming apparatus 120 of the second exemplary embodiment of the invention so that it becomes able to perform color printing.

As can be seen in FIG. 5, the image forming apparatus 120 is configured such that the first development unit 32 can be removed from the image forming apparatus main body 12 after the removal of the cover 86 from the image forming apparatus main body 12 rearward (to the right in FIG. 5).

The image forming apparatus 120 is configured such that, after the removal of the cover 86 and the first development unit 32 from the image forming apparatus main body 12, a color printing unit 90 in which the second development unit 46 and a transport path forming unit 88 are integrated can be installed instead of the cover 86 and the first development unit 32.

The transport path forming unit 88 includes a guide part 92 and transport rollers 64, 66 and this unit provides a lower part of the sub-transport path 70. The guide part 92 is formed of, for example, plural ribs disposed so as to face each other across the lower part of the sub-transport path 70. The guide part 92 guides a sheet having a developer image fixed thereon by the fixing device 24 toward a position (the converging point C) upstream of the registration rollers 30 in the main transport path 20, if switching to the sub-transport path 70 is done by the switching pawl 74 so that the sheet will be transported through the sub-transport path 70.

Therefore, when the color printing unit 90 is installed in the image forming apparatus main body 12, a loop transport path is formed in which a sheet is carried from the position (the converging point C) upstream of the registration rollers 30 in the main transport path 20 through the transfer position T and the fixing position A and, at the diverging point D, the sheet is guided to the sub-transport path 70 and transported to the converging point C again through the sub-transport path 70.

Thus, after removing the cover 86 and the first development unit 32 from the image forming apparatus main body 12, the user can change the image forming apparatus 120 so that it becomes able to perform color printing by installing the color printing unit 90.

Next, an image forming apparatus 130 according to a third exemplary embodiment of the invention is described.

Figure 6:
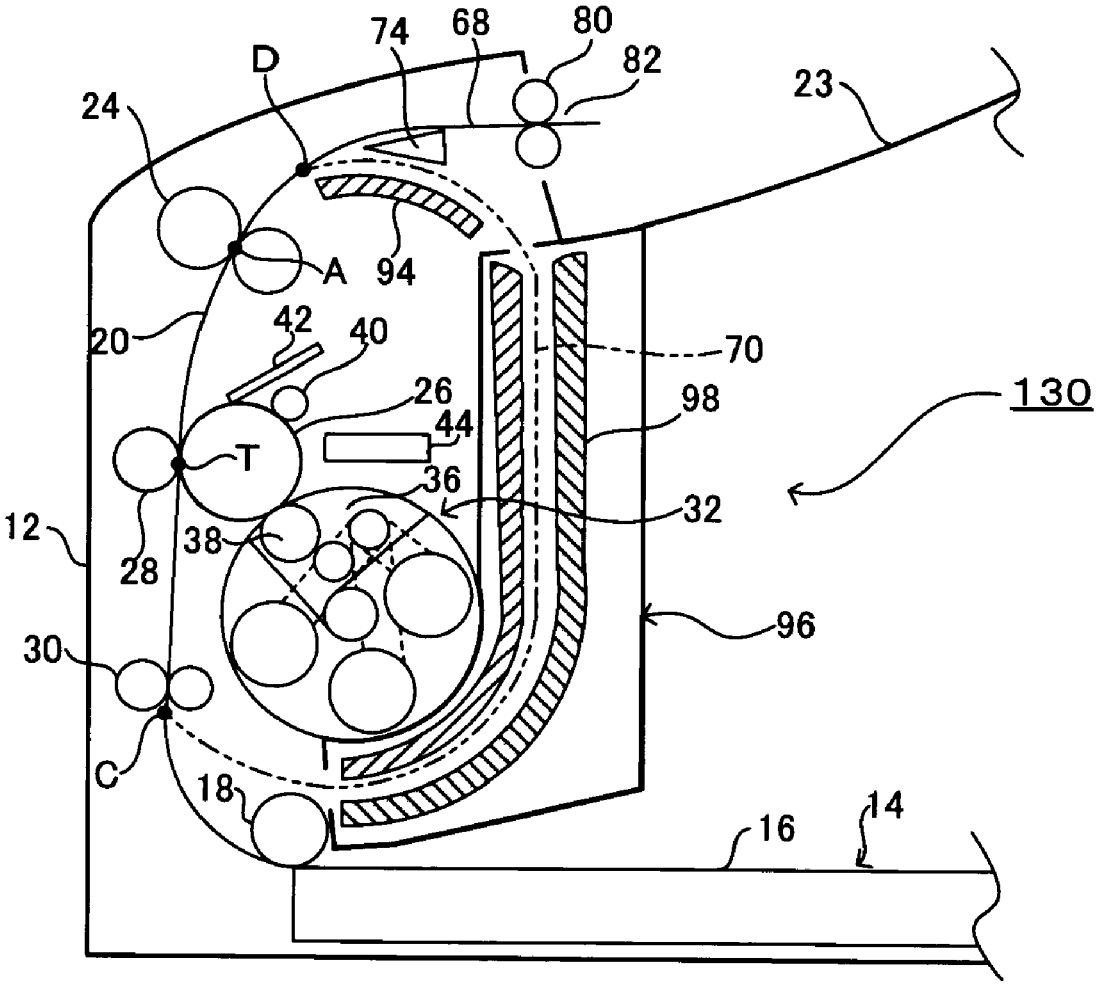
FIG. 6 is a side view depicting an overview of an image forming apparatus according to a third exemplary embodiment of the invention.

FIG. 6 is a side view depicting an overview of the image forming apparatus 130 according to the third exemplary embodiment of the invention.

In the image forming apparatus 130, components that are substantially the same as those constituting the image forming apparatus 120 shown in FIG. 4 are assigned the same reference numbers.

A guide part 94 is formed of plural ribs fixed in the image forming apparatus main body 12 to define an upper part of the sub-transport path 70. In the rear side (the right side in FIG. 6) of the image forming apparatus main body 12, a cover 96 is removably installed on the image forming apparatus main body 12. The cover 96 includes a guide part 98 to define a part of the sub-transport path 70, and the guide part 98 is, for example, formed of plural ribs disposed so as to face each other across a middle and lower part of the sub-transport path 70.

Thus, in the image forming apparatus 130, the exit path 68 and the sub-transport path 70 are provided beforehand. In the image forming apparatus 130, the distance of the passage from the fixing position A, extending through the diverging point D up to the converging point C is approximately equal to the length of the long sides of an A4 size sheet. This allows that, after a sheet having a developer image fixed thereon by the fixing device 24 is carried out of the fixing device 24, the sheet can be transported without the aid of the transport rollers 64, 66 which are not provided in this exemplary embodiment and arrives at the transfer position T at a proper timing adjusted by the registration rollers 30.

Then, a method for enabling the image forming apparatus 130 to perform color printing is described.

Figure 7:
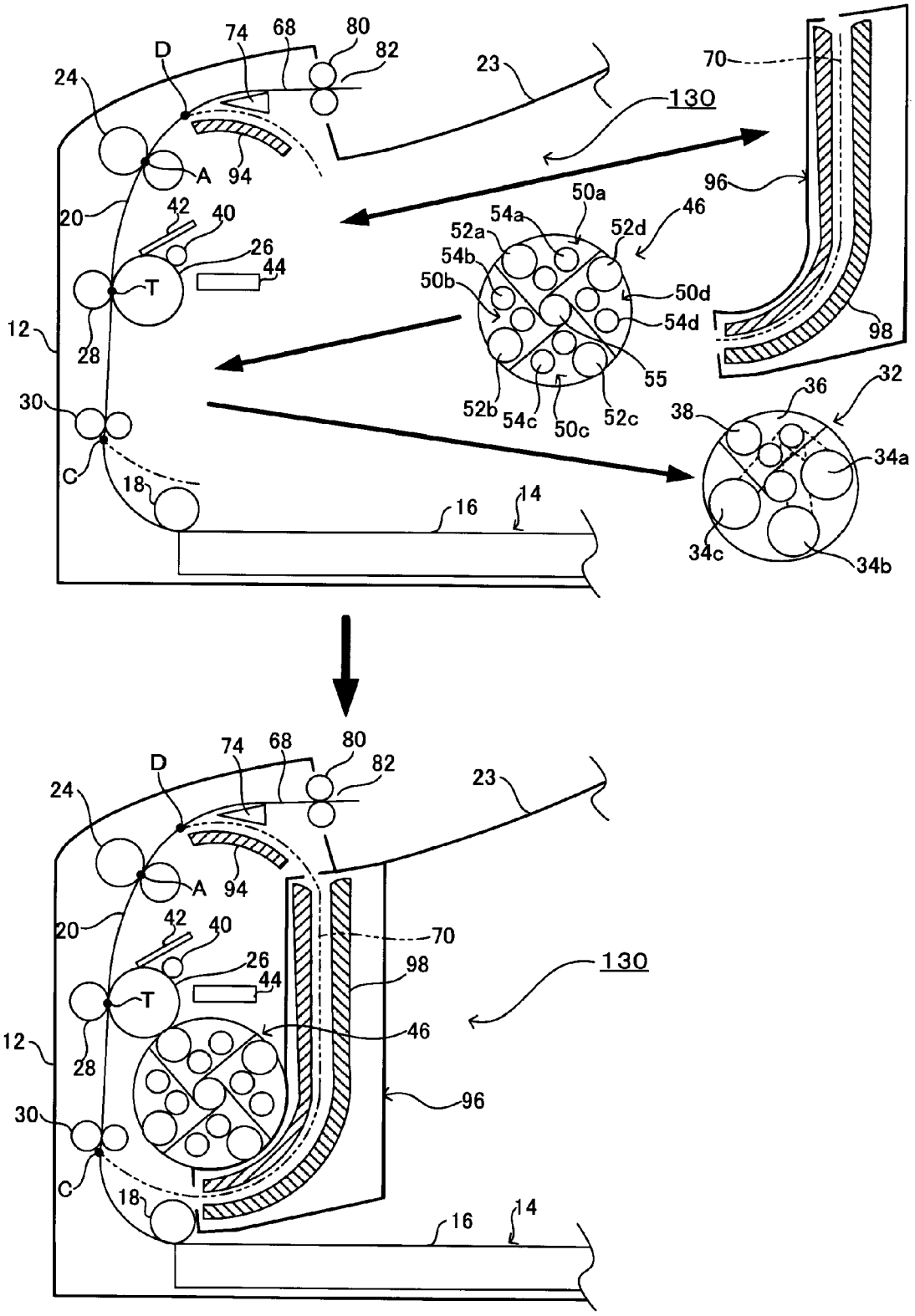
FIG. 7 is a side view depicting a process of changing the image forming apparatus of the third exemplary embodiment of the invention so that it becomes able to perform color printing.

FIG. 7 is a side view depicting a process of changing the image forming apparatus 130 of the third exemplary embodiment of the invention so that it becomes able to perform color printing.

As can be seen in FIG. 7, the image forming apparatus 130 is configured such that the first development unit 32 can be removed from the image forming apparatus main body 12 after the removal of the cover 96 from the image forming apparatus main body 12 rearward (to the right in FIG. 7).

The image forming apparatus 130 is also configured such that, after the removal of the cover 96 from the image forming apparatus main body 12, the second development unit 46 can be installed instead of the first development unit 32.

As described above, the cover 96 is configured to provide the middle and lower part of the sub-transport path 70. The guide part 98 guides a sheet having a developer image fixed thereon by the fixing device 24 toward the position (converging point C) upstream of the registration rollers 30 in the main transport path 20, if switching to the sub-transport path 70 is done by the switching pawl 74 so that the sheet will be transported through the sub-transport path 70.

Thus, after removing the cover 96 from the image forming apparatus main body 12, the user can change the image forming apparatus 130 so that it becomes able to perform color printing by installing the second development unit 46 instead of the first development unit 32 and installing the cover 96 again on the image forming apparatus main body 12.

The first development unit 32 and the second development unit 46 each may be a unit in which the image carrier 26, the charging device 40, the image carrier cleaner 42, and the optical writing device 44 are integrated, so that they can replaced with each other.

Next, a description is provided for a modification example of the first development unit 32 and the second development unit 46.

Figure 8:
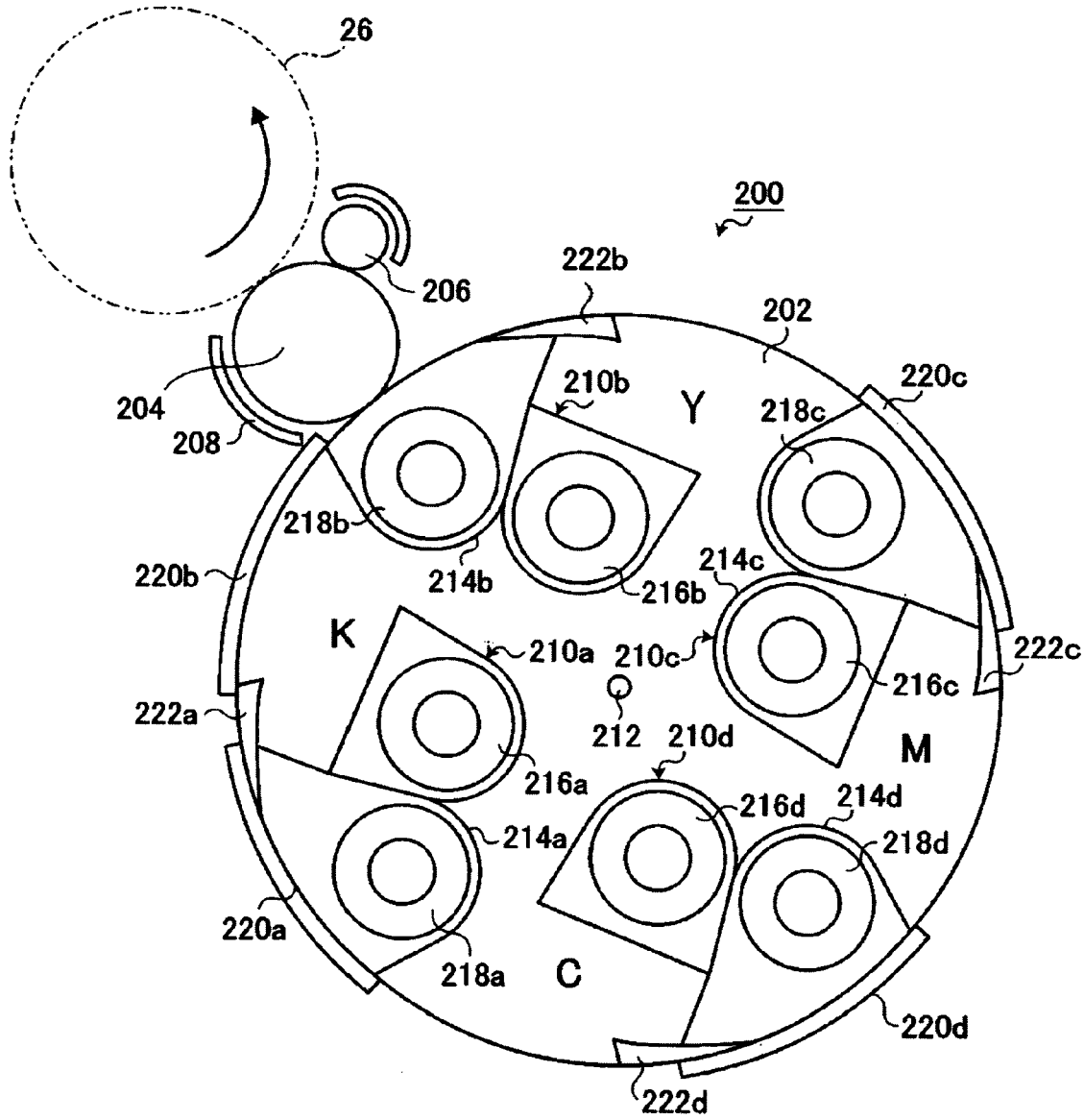
FIG. 8 is a side view depicting a modification example to a second development unit.

FIG. 8 is a side view depicting a modification example to the second development unit 46. In this modification, a development roller 204, a development roller casing wall 208, and a layer thickness restricting member 206 are included in the image forming apparatus main body, and a developer supply unit 200 can be used instead of the second development unit 46 used in the image forming apparatus 10, 110, 120, 130. The developer container of the development device 36, containing the black developer, in the first development unit 32 (for only black and white printing), as well as the developer containers 34*a* to 34*c* are replaced by the developer supply unit 200 which is installed in the main body of the image forming apparatuses 10, 110, 120, 130.

The developer supply unit 200 includes a rotary body 202 and developer feeders 210*a* to 210*d*.

In the following, to denote plural components such as developer feeders 210*a* to 210*d* without identifying any of them, a simple notation such as a "developer feeder 210" may be used.

In the rotary body 202, the developer feeders 210*a* to 210*d* from which black, yellow, magenta, and cyan developers are fed to the development roller 204 in turn is removably installed. The rotary body 202 is allowed to rotate about its rotating shaft 212 counterclockwise (counterclockwise in FIG. 8), so that each of the developer feeders 210*a* to 210*d* will move to a position (developer feed position) where it faces and abuts the development roller 204.

Developers contained in the developer feeders 210*a* to 210*d* are two-component developers including, for example, a nonmagnetic toner and a magnetic carrier.

The development roller 204 is held in the development roller casing wall 208 with an opening to expose a portion of the development roller to face and abut the image carrier 26. In fact, a predetermined gap is defined between the development roller 204 and the image carrier 26. The development roller 204 supplies each color developer attracted onto its surface by a magnetic force to the image carrier 26. The layer thickness restricting member 206 restricts the thickness of a developer layer attracted onto the surface of the development roller 204 (present on the surface of the development roller 204).

A developer feeder 210 is composed of a feeder casing 214, a first stirring and feeding member 216 and a second stirring and feeding member 218. The first stirring and feeding member 216 feeds the developer, while stirring it, to the second stirring and feeding member 218. The second stirring and feeding member 218 stirs and feeds the developer to the development roller 204.

The developer circulates within the feeder casing 214, while being stirred by the first stirring and feeding member 216 and the second stirring and feeding member 218, so that nonmagnetic toner particles cling to the periphery of a magnetic carrier.

The developer feeder 210 is also provided with an opening and closing member 220 to prevent developer particles from flowing out excessively and a scarping member 222 that scrapes away developer particles remaining on the development roller 204.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus comprising:

a first unit including at least a development unit that develops an electrostatic latent image and a first developer container containing a developer;

an image carrier that holds an electrostatic latent image to be developed by the development unit;

a transfer unit that transfers a developer image developed by the development unit onto a recording medium;

a fixing device that fixes the developer image transferred to the recording medium by the transfer unit onto a recording medium; and an image forming apparatus main body in which the first unit is installed, the image forming apparatus main body being configured such that a second unit including at least a plurality of second developer containers respectively containing developers of different colors for developing an electrostatic latent image and development units for respective colors is installable instead of the first unit and, when the second unit is installed, a loop transport path is provided to allow the recording medium having the developer image fixed thereon by the fixing device to be transported around the second unit and toward the transfer unit.

2. The image forming apparatus according to claim 1, wherein the first unit includes at least the first developer container;

the second unit includes at least the plurality of second developer containers respectively containing developers of different colors; and the development unit is included in the image forming apparatus main body.

3. The image forming apparatus according to claim 1, wherein the first unit and the second unit further include an image carrier that holds an electrostatic latent image to be developed by the development unit.

4. The image forming apparatus according to claim 3, wherein the first unit and the second unit further include an optical writing device that forms an electrostatic latent image to be developed by the development unit.

5. The image forming apparatus according to claim 1, wherein the image forming apparatus main body is configured such that a transport path forming unit is installed therein, when the second unit is installed, the transport path forming unit including at least any of the following:

a switching unit that switches between an exit path to transport the recording medium having the developer image fixed thereon by the fixing device to an exit port and the loop transport path; a guide unit that guides a recoding medium, thus providing a part of the loop transport path; and a transport unit that transports a recording medium in the loop transport path.

6. The image forming apparatus according to claim 5, wherein the transport path forming unit is installed in and removed from the image forming apparatus main body in conjunction with the second unit.

7. The image forming apparatus according to claim 1, further comprising a developer container shifting unit that moves each of the plurality of second developer containers to a position where each of the developer containers faces and abuts the image carrier in turn.

8. The image forming apparatus according to claim 7, wherein the developer container shifting unit rotates the plurality of second developer containers about one rotating shaft, so that each of the developer containers will be moved to a position where each of the developer containers faces and abuts the image carrier in turn.

9. An image forming apparatus comprising:

an image carrier;

a first unit including at least a development unit that develops an electrostatic latent image present on the image carrier and a plurality of first developer containers respectively containing developers of different colors;

an optical writing device that forms an electrostatic latent image on the image carrier;

a transfer unit that transfers a developer image appearing on the image carrier onto a recording medium;

a fixing device that fixes the developer image transferred to the recording medium by the transfer unit onto a recording medium; and an image forming apparatus main body in which the first unit is installed, the image forming apparatus main body being configured such that a second unit including at least a second developer container containing a developer for developing the electrostatic latent image present on the image carrier and a development unit is installable instead of the first unit and, when the first unit is installed, a loop transport path is provided to allow the recording medium having the developer image fixed thereon by the fixing device to be transported around the first unit and toward the transfer unit.

* * * * *